US007381270B2

(12) United States Patent
Shimai et al.

(10) Patent No.: US 7,381,270 B2
(45) Date of Patent: Jun. 3, 2008

(54) SLIT NOZZLE AND APPARATUS FOR SUPPLYING TREATMENT LIQUID USING SLIT NOZZLE

(75) Inventors: Futoshi Shimai, Kanagawa (JP); Shigeru Kawata, Kanagawa (JP)

(73) Assignee: Tokyo Ohka Kogya Co., Ltd., Kanagawa (JP)

( * ) Notice: Subject to any disclaimer, the term of this patent is extended or adjusted under 35 U.S.C. 154(b) by 134 days.

(21) Appl. No.: 11/214,480

(22) Filed: Aug. 29, 2005

(65) Prior Publication Data

US 2007/0044712 A1 Mar. 1, 2007

(51) Int. Cl.

| | |
|---|---|
| ***B05C 5/00*** | (2006.01) |
| ***B05C 11/00*** | (2006.01) |
| ***B05C 3/00*** | (2006.01) |
| ***B05B 1/04*** | (2006.01) |

(52) U.S. Cl. ..... 118/300; 118/667; 118/410; 239/568

(58) Field of Classification Search ..... 118/52, 118/612, 666, 300, 313, 401, 402, 404, 410, 118/667; 239/568, 601, 597, 599; 396/611, 396/627; 427/240

See application file for complete search history.

(56) References Cited

U.S. PATENT DOCUMENTS 6,258,167 B1 * 7/2001 Kawano et al. ..... 118/667

FOREIGN PATENT DOCUMENTS

| | | | |
|---|---|---|---|
| JP | 63-39658 | | 12/1994 |
| JP | 11145044 A | * | 5/1999 |
| JP | 2000102759 | | 4/2000 |
| JP | 2001000907 | | 1/2001 |
| JP | 3236703 | | 9/2001 |

OTHER PUBLICATIONS

English traslated Abstract and detailed descriptions of JP411145044A.*

* cited by examiner

*Primary Examiner*—Yewebdar Tadesse
(74) *Attorney, Agent, or Firm*—Carrier, Blackman & Associates, P.C.; Joseph P. Carrier; William D. Blackman

(57) ABSTRACT

A slit nozzle which is easily manufactured and in which no capillary action occurs, and an apparatus for supplying a treatment liquid using the slit nozzle are disclosed. The slit nozzle is constructed of a left portion and a right portion joined to each other, one of which is made of metal and the other of which is made of resin. In the apparatus for supplying a treatment liquid using one or more of the slit nozzles, the slit nozzles are provided in a circulating passage of a treatment liquid whose temperature is controlled.

17 Claims, 5 Drawing Sheets

SLIT NOZZLE AND APPARATUS FOR SUPPLYING TREATMENT LIQUID USING SLIT NOZZLE

BACKGROUND OF THE INVENTION

1. Field of the Invention

The present invention relates to a slit nozzle comprising left and right portions made of different materials, and an apparatus for supplying a treatment liquid using the slit nozzle.

2. Description of Background Art

Conventionally, there has been known a slit nozzle in which an opening of a predetermined width for ejecting a coating liquid is provided, and the nozzle is moved relatively with respect to an object to be treated so as to apply a coating liquid to the object to be treated in a predetermined width. With the slit nozzle having an opening of a predetermined width, it is possible to apply a coating liquid efficiently without wasting the coating liquid.

However, as an object to be treated becomes large, a single slit nozzle has limits with respect to the time and the amount of supplying a coating liquid. For example, if it takes too much time from the start of supplying a coating liquid to the finish, non-uniformity undesirably occurs. This problem occurs when a coating liquid is supplied so as to form a thick coating.

In order to supply a coating liquid so as to form a thick coating, Document 1 has disclosed that a coating liquid is applied to an object to be coated two times by using two application heads (i.e., slit nozzles) each of which comprises left and right portions.

Document 2 has disclosed that a predetermined thickness profile is formed in the ends of a coating film within a short range without non-uniformity by using two application dies (i.e., slit nozzles) each of which comprises left and right portions and has a slit of a width different from that of the other die. By using such two dies, the position where the coating liquid is applied is displaced with respect to the width direction, and the applied area becomes different. As a result of this, it is possible to form a desired thickness profile with respect to the width direction.

Document 3 has disclosed that a coating liquid is applied to an object to be coated by using two dies at the same time, each of which comprises left and right portions, in a state where the coating liquid ejected from a coating apparatus is not layered on the object to be coated.

[Document 1] Japanese Patent No. 3236703 (pages 4-6, FIG. 9)

[Document 2] Japanese Patent Application Publication No. 2000-102759 (pages 5-10, FIG. 4)

[Document 3] Japanese Patent Application Publication No. 2001-907 (pages 4-8, FIG. 2)

However, in the conventional art, it is necessary to perform accurate processing to hard metal such as stainless steel or SUS in order to manufacture a slit nozzle because the ejection opening and the ejection width of the slit nozzle needs to be very precise. It takes a lot of time and labor to perform such accurate processing, and also it is expensive.

In addition, even if accuracy of the processing is improved as much as possible, a very small gap is generated partly in the boundary of the two portions of the slit nozzle due to the large width of the slit nozzle, in which capillary action occurs and the treatment liquid soaks therethrough. This small volume of treatment liquid becomes a particle or the like when it is dried and/or cured.

The present invention was made to solve the above-mentioned problems, and the object of the present invention is to provide a slit nozzle and an apparatus for supplying a treatment liquid using the slit nozzle in which processing to a slit nozzle is easy, and no capillary action occurs.

SUMMARY OF THE INVENTION

According to the present invention, there is provided a slit nozzle comprising left and right portions, wherein the material for one of the left and right portions is metal, and the material for the other is resin.

By using a hard material (metal) as one of the slit nozzle portions and a soft material (resin) as the other, when the two portions are joined, the soft material adheres to the hard material, and thereby no gaps which may cause capillary action are generated. In addition, since the present invention does not require such accuracy of the processing as the conventional art, it is possible to reduce the processing time.

A plurality of slit nozzles each of which comprises left and right portions made of different materials may be used so as to reduce the time required for supplying a treatment liquid and finish coating within a short period of time even in a case of forming a thick film.

The slit nozzle comprising left and right portions made of a different material may be provided in a circulating passage of a treatment liquid whose temperature is controlled. With this, it is possible to reduce the time required for supplying a treatment liquid, and also control the temperature of the treatment liquid to be a desired one within a short period of time.

DETAILED DESCRIPTION OF PREFERRED EMBODIMENTS

Figure 1B:
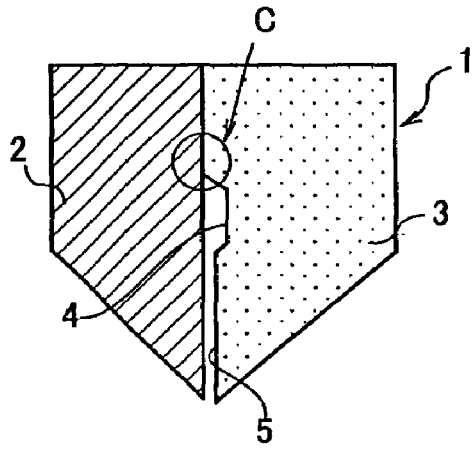
FIGS. 1A and 1B are a perspective view and an enlarged sectional view of a slit nozzle according to the present invention.
Figure 1A:
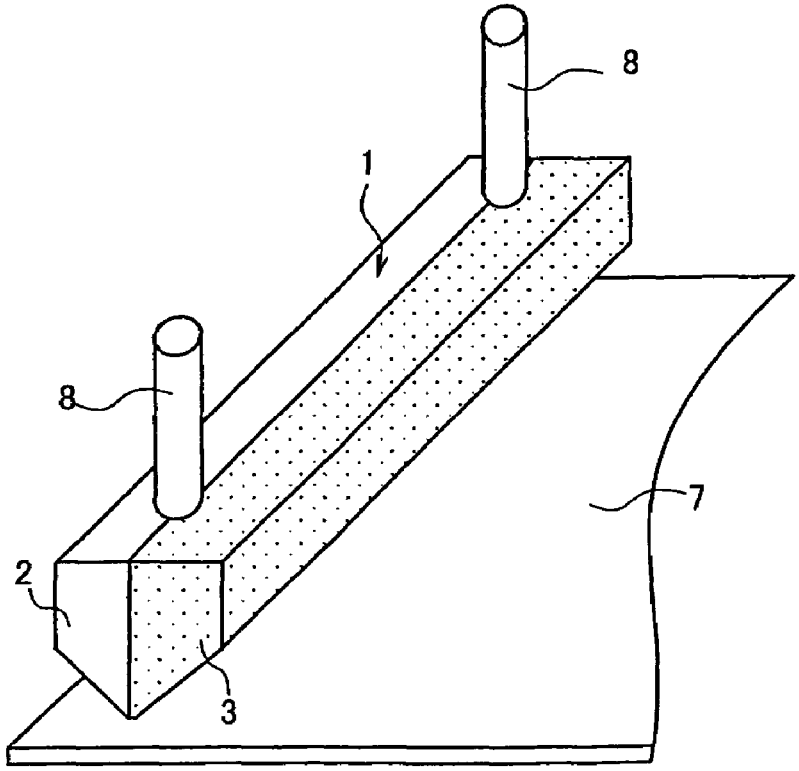
Figure 2A:
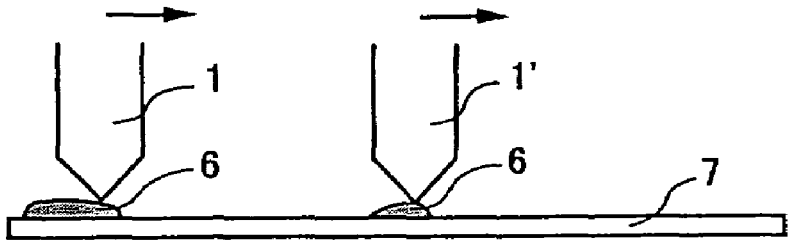
FIGS. 2A and 2B are a schematic view showing the case where a treatment liquid is supplied by using a plurality of slit nozzles according to the present invention.
Figure 2B:
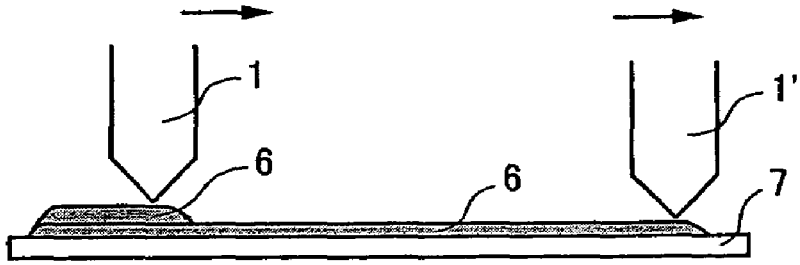
Figure 3:
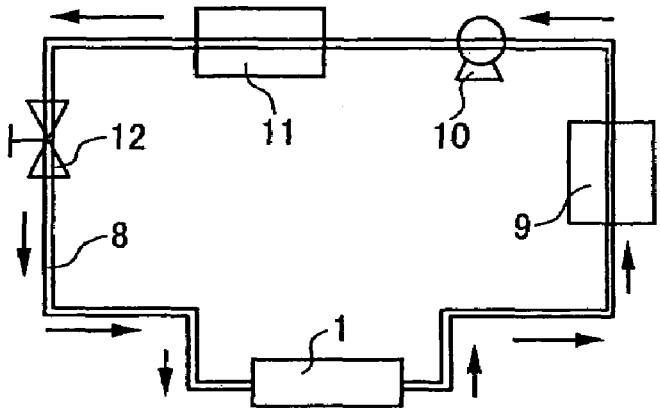
FIG. 3 is a schematic view showing direct temperature control by using a slit nozzle according to the present invention.
Figure 4:
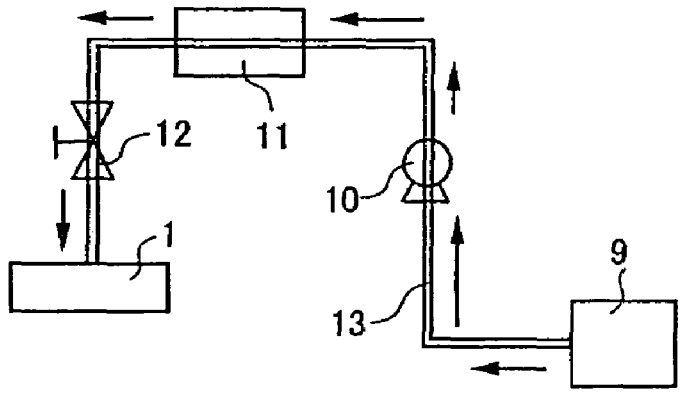
FIG. 4 is a schematic view showing indirect temperature control by using a slit nozzle.

Hereinafter, embodiments according to the present invention will be explained with reference to the attached drawings. FIGS. 1A and 1B are a perspective view and an enlarged sectional view of a slit nozzle according to the present invention, FIGS. 2A and 2B are a schematic view showing the case where a treatment liquid is supplied by using a plurality of slit nozzles according to the present invention, FIG. 3 is a schematic view showing direct temperature control which comprises a slit nozzle according to the present invention and a temperature controller, and FIG. 4 is a schematic view showing indirect temperature control according to the conventional apparatus.

As shown in FIG. 1, a slit nozzle 1 is constructed of a left portion 2 made of titanium and a right portion 3 made of PPS (polyphenylene sulfide) which are joined with respect to each other. The right portion 3 has a recessed portion 4 for forming a manifold (lateral passage) and a flat surface 5 for forming a longitudinal passage which is shallower than the bottom surface of the recessed portion 4. Incidentally, the left portion 2 can be made of stainless steel.

By using a metal-based material for the left portion 2 and a resin-based material for the right portion 3, the soft resin-based material adheres to the hard metal-based material without any resistance. Consequently, no gaps are generated between the two portions and no capillary action occurs. The left portion 2 may be made of resin, the right portion 3 may be made of metal, and the manifold may be provided in the portion made of metal as long as the boundary between the left and right portions shown by a circle C of FIG. 1, can be joined.

A conventional slit nozzle is made of a metal material such as stainless steel which is relatively hard so as to achieve required accuracy. Its structure is comprised of left and right portions which are joined to each other. In this conventional case, a shim is interposed so as to form a slit-like opening, or an irregular portion is provided in either one of the left and right portions or both. However, in the case where both of the left and right portions are made of metal, even if the surface is processed to be flat very accurately, a small gap is generated between the boundary of the left and right portions, again, corresponding to the circle C of FIG. 1 because the width of the nozzle is large in the lateral direction, and the treatment liquid soaks therethrough due to capillary action. However, according to the structure of the present invention, it is possible to solve this drawback.

As shown in FIG. 2 (A), when two slit nozzles 1, 1' are used to supply a treatment liquid 6, it does not take a long period of time to supply the treatment liquid 6 even to a large-scale substrate 7. In other words, if the treatment liquid 6 is supplied to have the same thickness from different starting positions of the large-scale substrate 7 simultaneously, the treatment liquid 6 can be supplied to the large-scale substrate 7 without increasing the time required for supplying the treatment liquid 6. For example, when the treatment liquid 6 is supplied from two starting positions, it becomes possible to supply the treatment liquid 6 to a large-scale substrate of 1100×1300 mm or more within the same period of time as a small-scale substrate of 550×650 mm.

As shown in FIG. 2 (B), when the treatment liquid 6 is supplied from the same starting position of the substrate 7 using two slit nozzles 1, 1', a large volume of treatment liquid 6 can be supplied within the same period of time by adjusting the supplied amount. In other words, it does not take a long period of time to supply a treatment liquid even in a case of a thick film by layering the treatment liquid plural times with a plurality of slit nozzles rather than applying a treatment liquid to have a large thickness with only one slit nozzle.

FIG. 3 shows a circulating pipe 8 provided with the slit nozzle 1. A tank 9, a pump 10, a temperature controller 11 and a valve 12 are positioned in the path of the circulating pipe 8. FIG. 4 shows a one-way pipe 13 provided with the slit nozzle 1. A tank 9, a pump 10, a temperature controller 11 and a valve 12 are positioned in the path of the one-way pipe 13.

Figure 5:
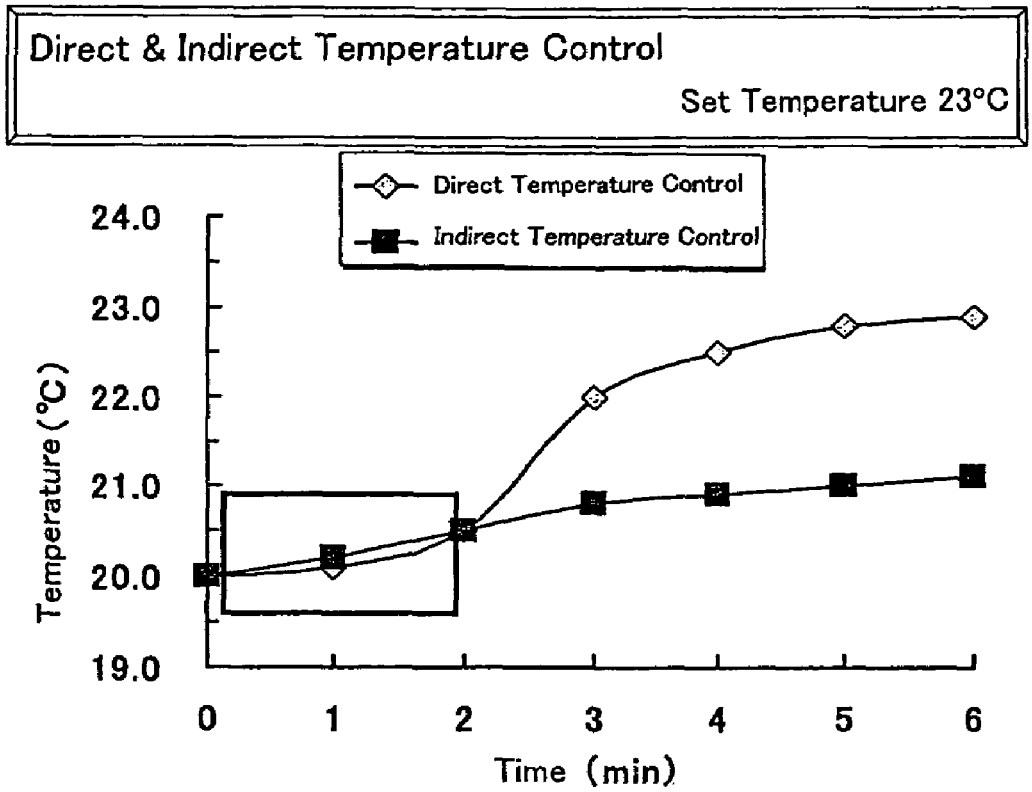
FIG. 5 is a graph of temperature distribution in a circulating pipe in the cases of direct and indirect temperature control at a set temperature of 23° C.

In the case of FIG. 3, the treatment liquid 6 whose temperature is controlled to be a predetermined value by the temperature controller 11 is circulated through the circulating pipe 8. The temperature of the treatment liquid 6 is controlled to be 23° C. in the temperature controller 11, and the treatment liquid 6 is circulated through the circulating pipe 8. When the treatment liquid 6 is returned to the temperature controller 11, the temperature of the treatment liquid 6 might be slightly lower than 23° C. However, the temperature of the treatment liquid 6 is controlled again to be 23° C. in the temperature controller 11, and then the treatment liquid 6 is circulated again. Consequently, the whole pipe 8 is controlled to be 23° C. for a short period of time as shown in FIG. 5 and Table 1. This is referred to as "direct temperature control".

In the case of FIG. 4, the treatment liquid 6 whose temperature is controlled to be a predetermined value by the temperature controller 11 is supplied to the slit nozzle 1 via the one-way pipe 13. The temperature of the treatment liquid 6 supplied from the tank 9 to the pump 10 is controlled to be 23° C. in the temperature controller 11, and the temperature of the treatment liquid 6 becomes lower than 23° C. at the time of reaching the nozzle 1. In this case, since a new treatment liquid 6 is always supplied, the pipe 13 is not easily controlled to be 23° C. even after the elapse of a lot of time as shown in FIG. 5 and Table 1. This is referred to as "indirect temperature control".

TABLE 1

| | Time | | | | | | |
|---|---|---|---|---|---|---|---|
| | 0 | 1 | 2 | 3 | 4 | 5 | 6 |
| Direct | 20.0 | 20.2 | 20.5 | 22.0 | 22.5 | 22.8 | 23.0 |
| Indirect | 20.0 | 20.1 | 20.5 | 20.8 | 20.9 | 21.0 | 21.2 |

Figure 6:
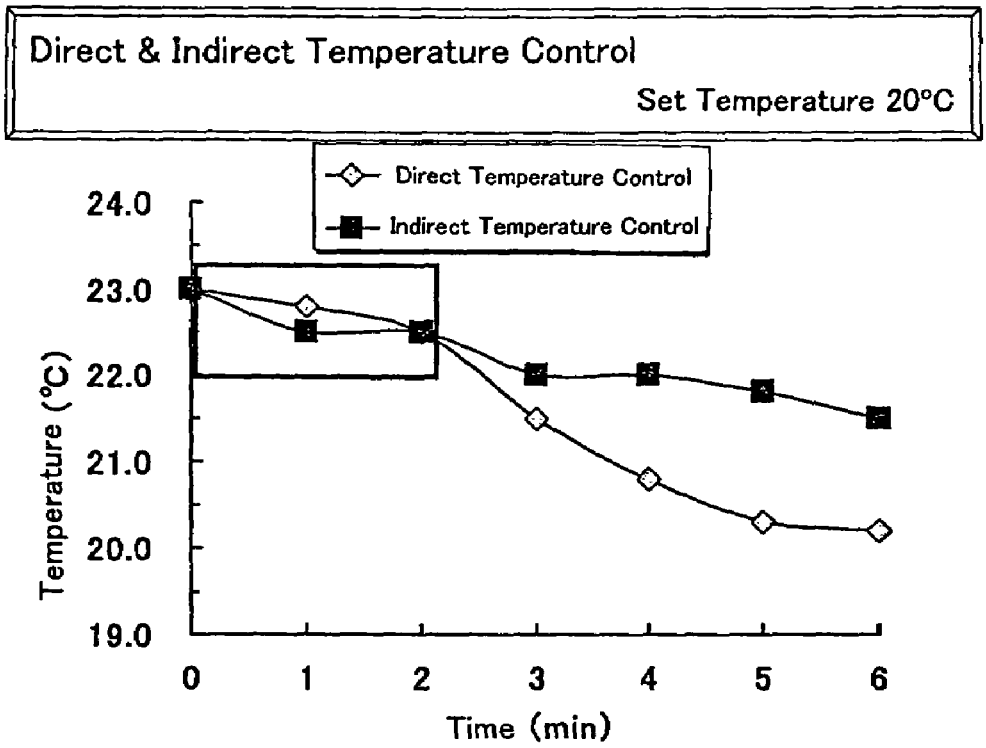
FIG. 6 is a graph of temperature distribution in a circulating pipe in the cases of direct and indirect temperature control at a set temperature of 20° C.

As shown in FIG. 6 and Table 2, the above-mentioned phenomena of direct temperature control and indirect temperature control occurred even when the target temperature was set to be 20° C.

TABLE 2

| | Time | | | | | | |
|---|---|---|---|---|---|---|---|
| | 0 | 1 | 2 | 3 | 4 | 5 | 6 |
| Direct | 23.0 | 22.5 | 22.5 | 21.5 | 20.8 | 20.4 | 20.1 |
| Indirect | 23.0 | 22.8 | 22.5 | 22.0 | 22.0 | 21.9 | 21.6 |

As is explained in the above, according to the present invention, by using a hard material (metal) as one of the slit nozzle portions and a soft material (resin) as the other, when the two portions are joined, the soft material adheres to the hard material, and thereby no gaps which may cause capillary action are generated. In addition, the processing time can be reduced.

Also, by using a plurality of slit nozzles each of which comprises left and right portions made of a different material, the time required for supplying a treatment liquid can be reduced, and coating can be finished within a short period of time even in a case of a thick film.

In addition, by providing the slit nozzle comprising left and right portions made of different materials in a circulating passage of a treatment liquid whose temperature is controlled, the temperature of the treatment liquid can be controlled to be a desired one within a short period of time.

Although there have been described what are the present exemplary embodiments of the invention, it will be understood that variations and modifications may be made thereto within the spirit and scope of the appended claims.

What is claimed is:

1. A slit nozzle for supplying a treatment liquid with a predetermined width to a surface of a material to be treated comprising:

a left portion; and a right portion;

wherein one of the left and right portions is formed of metal, and the other of the left and right portions is formed of resin;

wherein opposing surfaces of said left and right portions define an elongated slit therebetween when said left and right portions are joined together along a boundary extending in a plane with said elongated slit; and wherein said left and right portions each are half portion of said slit nozzle.

2. An apparatus for supplying a treatment liquid comprising the slit nozzle according to claim 1 and a temperature controller which controls temperature of a treatment liquid, wherein the slit nozzle and the temperature controller are provided in a circulating passage of the treatment liquid.

3. The apparatus for supplying a treatment liquid according to claim 2, including a plurality of the slit nozzles.

4. The apparatus for supplying a treatment liquid according to claim 2, further comprising said circulating passage, and said temperature controller maintains a treatment liquid in said circulating passage at a substantially constant temperature.

5. The slit nozzle according to claim 1, wherein said left and right portions are joined together along a boundary, and an elongate slit is defined between lower ends of said left and right portions.

6. The slit nozzle according to claim 5, wherein at least one of said left and right portions includes a manifold for the treatment liquid, said manifold extending continuously into said elongate slit.

7. The slit nozzle according to claim 5, wherein the other of said left and right portions formed of resin includes a manifold for the treatment liquid, said manifold extending continuously into said elongate slit.

8. The slit nozzle according to claim 1, wherein said left and right portions are joined together along a boundary such that no gaps are generated in the boundary through which capillary action of the treatment liquid may occur.

9. The slit nozzle according to claim 1, wherein the one of said left and right portions is formed of at least one of titanium and stainless steel, and the other of said left and right portions is formed of polyphenylene sulfide.

10. A slit nozzle for supplying a treatment liquid with a predetermined width to a surface of a material to be treated comprising:

a left portion; and a right portion;

wherein one of the left and right portions is formed of metal, and the other of the left and right portions is formed of resin; and wherein said left and right portions each constitute approximately half of the slit nozzle, and said left and right portions are joined together along surfaces extending substantially parallel to a slit of the nozzle.

11. A slit nozzle for supplying a treatment liquid with a predetermined width to a surface of a material to be treated comprising:

a first half portion and a second half portion joined together along a boundary, and defining an elongate slit between lower ends thereof;

wherein one of the first and second half portions is formed of metal and the other of the first and second half portions is formed of resin.

12. The slit nozzle according to claim 11, wherein at least one of said first and second half portions includes a manifold for the treatment liquid, said manifold extending continuously into said elongate slit.

13. The slit nozzle according to claim 11, wherein the half portion formed of resin includes a manifold for the treatment liquid, said manifold extending continuously into said elongate slit.

14. The slit nozzle according to claim 11, wherein said first and second half portions are joined together along a boundary such that no gaps are generated in the boundary through which capillary action of the treatment liquid may occur.

15. The slit nozzle according to claim 11, wherein the one of said first and second half portions is formed of at least one of titanium and stainless steel, and the other of said first and second half portions is formed of polyphenylene sulfide.

16. An apparatus for supplying a treatment liquid comprising the slit nozzle according to claim 11 and a temperature controller which controls temperature of a treatment liquid, wherein the slit nozzle and the temperature controller are provided in a circulating passage of the treatment liquid.

17. The apparatus for supplying a treatment liquid according to claim 16, including a plurality of the slit nozzles.

* * * * *

UNITED STATES PATENT AND TRADEMARK OFFICE

CERTIFICATE OF CORRECTION

PATENT NO. : 7,381,270 B2
APPLICATION NO. : 11/214480
DATED : June 3, 2008
INVENTOR(S) : Shimai et al.

It is certified that error appears in the above-identified patent and that said Letters Patent is hereby corrected as shown below:

Title page:

Item (73), "Assignee:", change "Kogya" to --Kogyo--.

Item (56), "References Cited", under "OTHER PUBLICATIONS", change "traslated" to --translated--.

Column 2:

Lines 20-21, change "nozzles each of which comprises left and right portions made of different materials may be" to --nozzles, each of which comprises left and right portions made of different materials, may be--.

Lines 66-67, change "control according to" to --control in use of a slit nozzle according to--.

Column 3:

Line 17, change "left and right portions shown by" to --left and right portions, shown by--.

Lines 53-54, change "liquid even in a case of a thick film by layering" to --liquid, even in a case of a thick film, by layering--.

Line 55, change "slit nozzles rather than" to --slit nozzles, rather than--.

Column 4:

Line 51, change "material, and thereby no gaps which" to --material and, thereby, no gaps, which--.

Line 52, change "lary action are" to --lary action, are--.

Signed and Sealed this

Fourteenth Day of October, 2008

JON W. DUDAS
*Director of the United States Patent and Trademark Office*